US006427357B1

(12) United States Patent
Piper

(10) Patent No.: US 6,427,357 B1
(45) Date of Patent: Aug. 6, 2002

(54) SPINDLE MOUNTED MARKING DEVICE FOR CNC MACHINES

(76) Inventor: Thomas W. Piper, 6 N. Blandford Rd., Blandford, MA (US) 01008

( * ) Notice: Subject to any disclaimer, the term of this patent is extended or adjusted under 35 U.S.C. 154(b) by 0 days.

(21) Appl. No.: 09/626,254

(22) Filed: Jul. 26, 2000

Related U.S. Application Data

(60) Provisional application No. 60/148,664, filed on Aug. 13, 1999.

(51) Int. Cl.[7] ..... B25H 7/00

(52) U.S. Cl. ..... 33/679; 33/18.1; 33/666; 33/678

(58) Field of Search ..... 33/18.1, 27.01, 33/503, 666, 678, 679, 574, 579

(56) References Cited

U.S. PATENT DOCUMENTS

| | | | | | |
|---|---|---|---|---|---|
| 3,818,597 | A | * | 6/1974 | Shmied | 33/18.1 |
| 4,599,799 | A | * | 7/1986 | Lopez | 33/18.1 |
| 4,642,897 | A | * | 2/1987 | Kirsch | 33/18.1 |
| 4,825,555 | A | * | 5/1989 | Murayama et al. | 33/18.1 |
| 5,042,155 | A | * | 8/1991 | Yoshioka et al. | 33/18.1 |
| 5,594,991 | A | * | 1/1997 | Therond | 33/18.1 |
| 6,188,148 | B1 | * | 2/2001 | Curreno | 33/18.1 |

* cited by examiner

*Primary Examiner*—Diego Gutierrez
*Assistant Examiner*—Madeline Gonzalez
(74) *Attorney, Agent, or Firm*—John A. Kramer, Esq.; Holland & Bonzagni, P.C.

(57) ABSTRACT

A marking device for a CNC machine tool or the like comprises a tubular body capped at either end with top and bottom plates. A main shaft extends down through the top plate along the central axis of the body, and is rotatably held in place by upper and lower bearings. A cylindrical cam having one or more cam lobes disposed on an underside thereof is attached to the main shaft within the body. A guide extends through the bottom plate and slidably supports a spring-biased stylus, an upper, anvil end of which normally tracks along the underside of the cam, and a lower, marking point end of which normally lies just within the guide. When the main shaft is rotated, e.g., by being operably connected to the machine tool's spindle, the cam also rotates, causing the cam lobes to strike the anvil and drive the stylus axially downwards through the guide and into a part or work piece. To create a complex pattern, the machine tool sets the spindle to rotate at a constant rate. Given the number of cam lobes and the spindle's rate of rotation, the machine will know the number of stylus extensions per minute, and the time there between. This allows the machining center to appropriately time the movement of the part and/or the marking device to produce the desired pattern.

38 Claims, 2 Drawing Sheets

SPINDLE MOUNTED MARKING DEVICE FOR CNC MACHINES

This application claims priority from a Provisional Application, Ser. No. 60/148,664, filed Aug. 13, 1999.

FIELD OF THE INVENTION

The present invention relates to devices for making marks in metal parts and other objects.

BACKGROUND OF THE INVENTION

For identification purposes, most manufactured parts are provided with some sort of identifying indicia stamped or marked thereon. For example, parts may be given a catalog number, a size number, a routing number, or a source identifier. To do so, the parts are first machined or otherwise manufactured, and then taken to a separate, dedicated machine for stamping or marking. This creates one or more additional steps in the manufacturing process, increasing the costs involved, not to mention the additional expense of the dedicated stamping machines themselves. Additionally, the stamp or punch in the stamping machine may need to be manually changed over each time a different identification indicia is required, further adding to manufacturing and labor costs.

Also, in many instances it may be necessary to provide a part with some sort of identifying indicia during the manufacturing process itself, before the part is finally finished. For example, if a common manufacturing line handles several different parts, indicia may be needed to properly sort the parts further down the line. Taking the parts off the line for stamping at a remote stamping machine is impracticable, if not impossible, and adding dedicated stamping machines on the manufacturing line increases both required capital outlay and manufacturing time.

Accordingly, a primary object of the present invention is to provide a marking device, meant for use with a general purpose machining center or other machine tool, that can mark and identify a machined part before the part is taken out of the machining center.

Another object of the present invention is to provide a marking device that eliminates the need to stamp or otherwise mark a machined part at a location removed from the machining center or manufacturing line.

Still another object of the present invention is to provide a marking device that can provide any number of marking indicia patterns.

SUMMARY OF THE INVENTION

A spindle mounted marking device, for use with CNC machines or other manufacturing or machining tools, is disclosed for marking and identifying machined parts. In a preferred embodiment, the marking device comprises a stationary, hollow, tubular body capped at either end with top and bottom plates. A main shaft extends down through the top plate along the central axis of the body, and is rotatably held in place by upper and lower bearings. A cylindrical cam having one or more cam lobes disposed on an underside thereof is attached to the main shaft within the body such that the cam rotates when the main shaft rotates. A spring-biased marking stylus slidably extends through a guide attached to the bottom plate, such that an upper, anvil portion of the stylus tracks along an underside of the cam, and a lower, marking tip portion of the stylus lies just within the guide.

For marking a part, the marking device's main shaft is operably connected to a machining center spindle. The machining center is controlled to position the guide just over the part to be marked, and to start the machine's spindle rotating. This in turn causes the main shaft and the cam to rotate. As the cam rotates, with the body remaining stationary, the cam lobe contacts the anvil portion of the stylus, forcing the stylus axially downwards through the guide and the marking tip against the part. Once the cam lobe passes the anvil, the stylus springs back into place against the underside of the cam until the cam lobe next comes around.

To create a complex pattern, the machining center moves the part and/or marking device, according to the particular pattern desired, as the stylus is periodically forced axially downwards, i.e., as it reciprocates. More specifically, the spindle is set to rotate at a constant rate. Given the number of cam lobes and the spindle's speed, the machine knows the number of stylus extensions per minute, and the time there between. This allows the machining center to appropriately time the movement of the part and/or the marking device to produce the desired indicia pattern.

BRIEF DESCRIPTION OF THE DRAWINGS

These and other features, aspects, and advantages of the present invention will become better understood with respect to the following description, appended claims, and accompanying drawings, in which:

DETAILED DESCRIPTION OF THE PREFERRED EMBODIMENT

Figure 1:
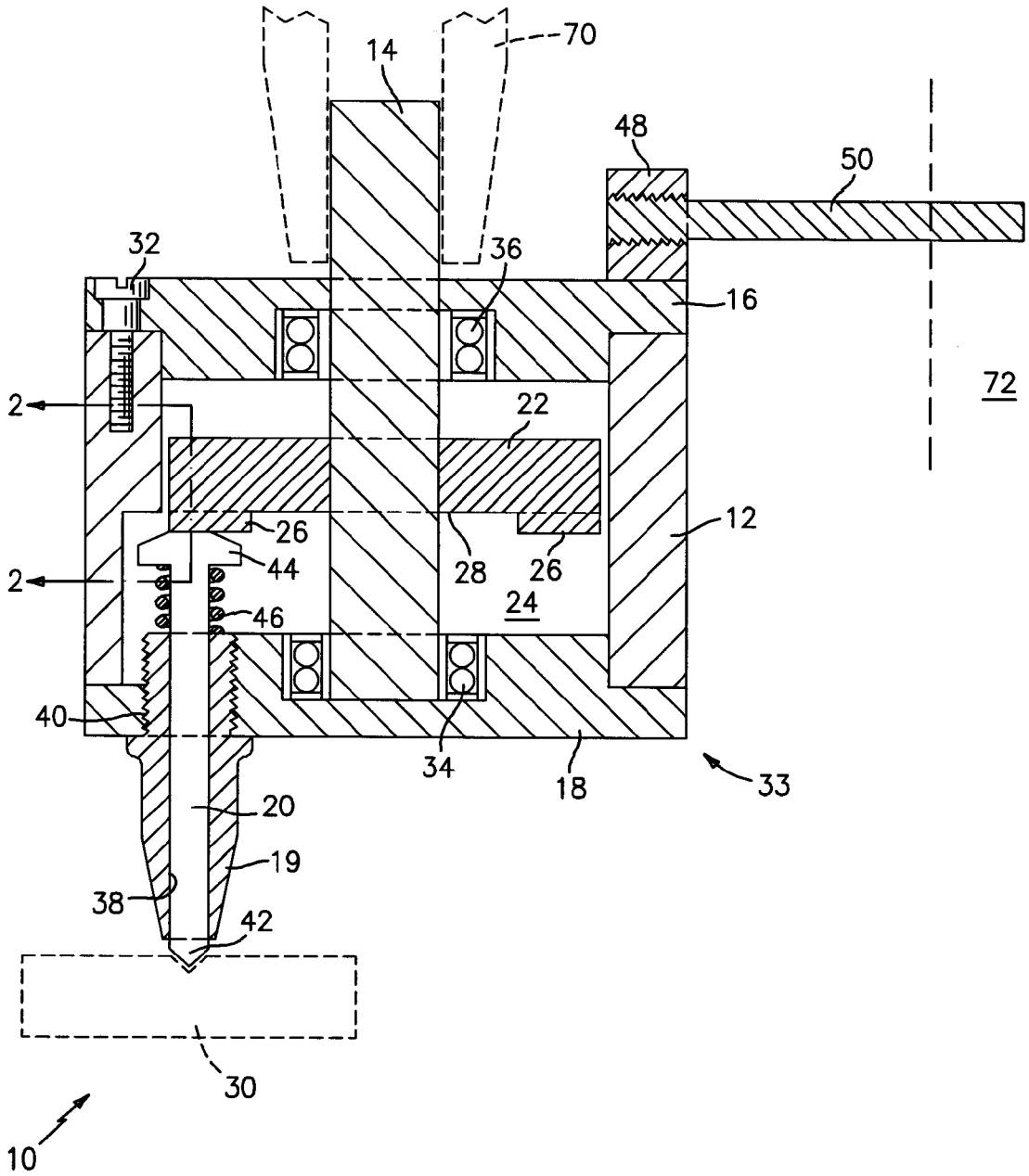
FIG. 1 is a cross-section elevation view of a spindle mounted marking device.
Figure 2:
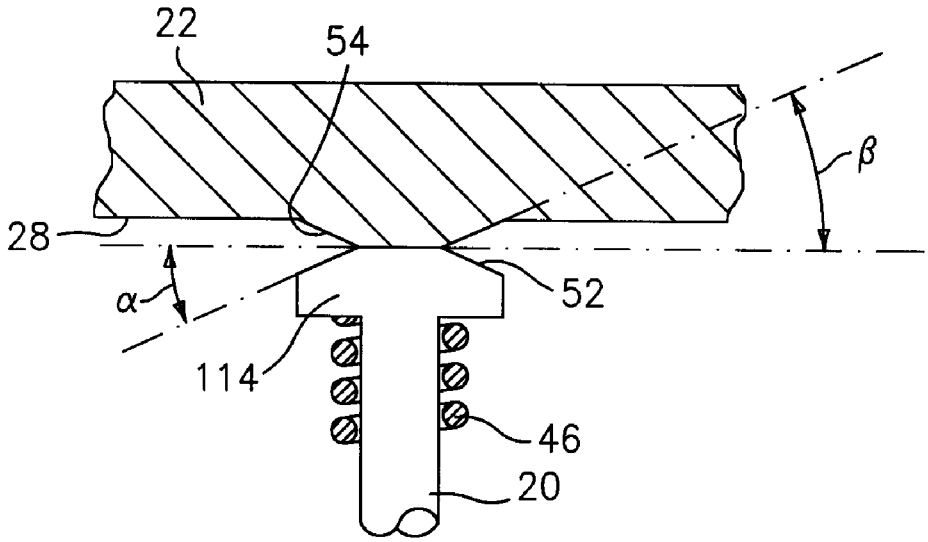
FIG. 2 is a partial cross-section elevation view of the spindle mounted marking device, taken along line 2—2 in FIG. 1.
Figure 3:
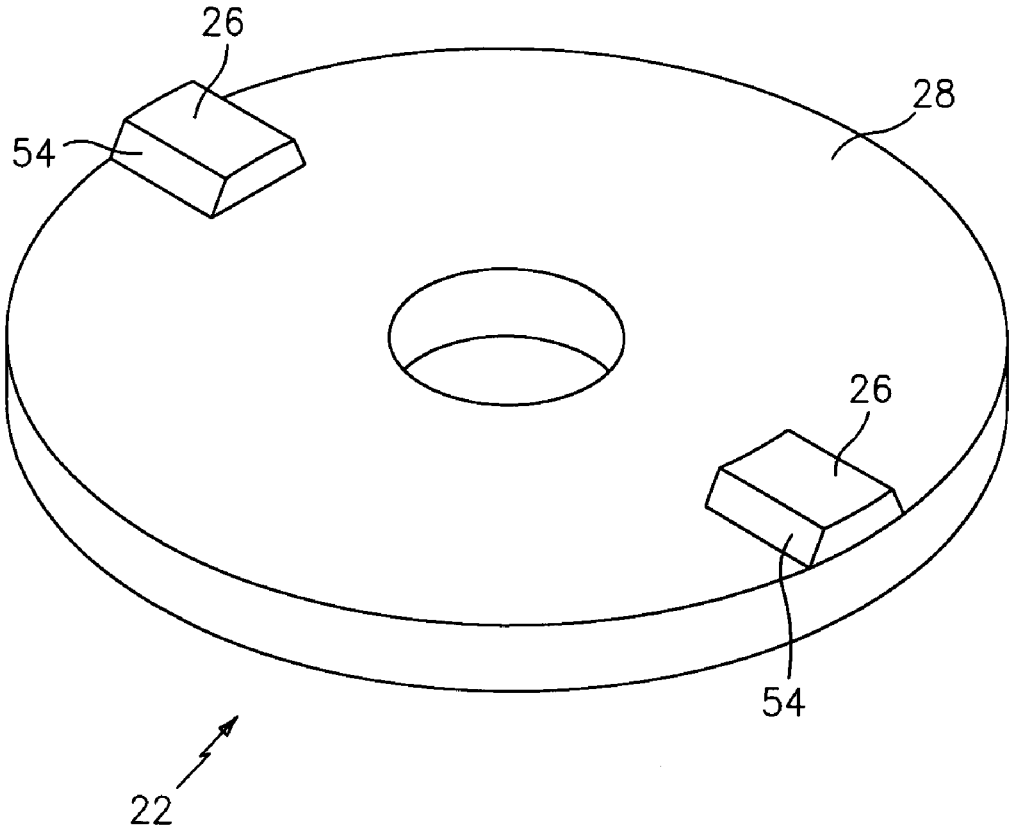
FIG. 3 is a perspective view of an underside of a cam portion of the spindle mounted marking device.

Turning now to FIGS. 1–3, a preferred embodiment of a spindle mounted marking device 10, according to the present invention, will now be given. The marking device 10 generally comprises a tubular body 12 rotatably connected to a main shaft 14 via respective top and bottom plates 16, 18 attached to the body 12. A guide 19, removably attached to and extending through the bottom plate 18, slidably supports a spring-biased stylus 20 extending through the guide 19. A cylindrical cam 22, located in an interior 24 of the body 12 and attached to the main shaft 14, has one or more cam lobes 26 disposed on an underside 28 thereof. The cam 22 rotates as the main shaft 14 rotates (e.g., under the action of a machine tool), causing the cam lobes 26 to periodically strike the stylus 20. In response, each time the lobes 26 hit the spring-biased stylus 20, it slides downwards through the guide 19 and extends into a metal part or work piece 30 located outside the device 10.

FIG. 1 best shows the overall assembly of the marking device 10. There, the generally tubular body 12 is capped at either end with the top and bottom plates 16, 18, all of which are made of anodized aluminum (the anodizing adds a small degree of surface hardness). The top and bottom plates 16, 18 are attached to the body 12 by a plurality of screws 32, only one of which can be seen in the cross-sectional plane of FIG. 1. Other fasteners or fastening methods may be used, such as nuts and bolts or welding. Effectively, the body 12 and top and bottom plates 16, 18 form a housing 33 for the marking device 10. Although described as a hollow cylinder herein, it should be appreciated that the housing 33 could be cubical, oval, or any other shape that is desired.

Besides sealing the interior 24 of the body 12, the top and bottom plates 16, 18 support the main shaft 14. For that purpose, a lower sealed roller bearing 34 is press fit into a central recess portion of the bottom plate 18. Additionally, an upper sealed roller bearing 36 is press fit into a central recess portion of the top plate 16. The main shaft 14, made of ground and hardened tool steel, is co-axial with the body 12, and is rotatably held in place by the lower and upper bearings 34,36. The main shaft 14 abuts an interior side of the lower plate 18, and extends up through the body interior 24 and top plate 16 to terminate outside the body 12 above the top plate 16. In use, the upper end of the main shaft 14 is inserted into a spindle portion of a machine tool, with the lower portion of the main shaft effectively supporting and driving the marking device 10. In this sense, the housing 33 is rotatably supported and fixed to the main shaft 14 by the two bearings 34, 36 mounted mid-point and at one end of the main shaft 14.

The preferred cam 22, made of ground and hardened tool steel, has a central through-bore (not numbered) and the one or more cam lobes 26 (further discussed below) attached to the cam's underside 28. The cam 22 is press fit onto the main shaft 14 so as to be positioned within the interior 24 of the body 12. The cam 22 is provided with two surface treatments subsequent machining. The first is the application of TiN (titanium nitride) by physical vapor deposition. This increases the surface hardness of the cam. The second surface treatment is the application of $MoS_2$ (molybdenum di-sulfide) to increase lubricity. Both these surface treatments can be accomplished according to standard methods well known to those of skill in the art.

The guide 19, turned from hardened tool steel, is roughly cylindrical in overall shape, and has a longitudinal through-bore 38 honed to provide a smooth, straight, low-friction surface for the stylus. One end of the guide 19 is provided with machined threading dimensioned to mate with a threaded aperture 40 extending through the bottom plate 18, such that the guide 20 can be screwed into and through the bottom plate 18. As can be seen in FIG. 1, a lower portion of the guide 19 extends axially away from the exterior side of the bottom plate 18. The guide 19 can be provided in different lengths and integral diameters based on the particular characteristics of the stylus 20 to be used in the marking device. Additionally, it should be appreciated that the guide 19 is optional, since the through-bore 38 could be provided directly in the bottom plate 18. In short, all that is required is that the stylus 20 be slidable or extendable through the housing 33, whether via the guide 19, the bottom plate 18 itself, or some other element.

As mentioned above, the guide 19 slidably supports and guides the stylus 20, which is a ground, solid carbide shaft having a conical marking tip or point 42 ground on one end and an anvil 44 brazed or otherwise attached to the other end. The preferred stylus is provided with a coating of $MoS_2$. A compression spring 46 is concentrically disposed about the stylus shaft and positioned between an upper end surface of the guide 19 and the underside of the anvil 44. In a normal or unextended position (not shown), the spring 46 causes the top of the anvil 44 to contact (or lie near) the underside 28 of the cam 22. In this position, the point 42 lies just within the confines of the guide through-bore 38. Alternatively, the point 42 can normally lie beyond the guide 19. The stylus 20 can be provided in any size as desired. Additionally, the point 42 does not have to be conical, but can be whatever shape is desired for the particular marking application at hand.

Finally, an attachment bracket 48 is attached to the exterior side of the top plate 16. The attachment bracket 48 has a threaded through-bore positioned such that a stop bar 50 threaded therein extends radially away from the marking device 10. The attachment bracket 48 and stop bar 50 are made of aluminum or another metal. Alternatively, the stop bar 50 can be attached to the top plate 16 or body 12 directly, via a threaded bore (not shown), welding, or the like.

In regards to the internal operation of the marking device 10, the main shaft 14 is attached to the spindle 70 of a machine tool 72 or some other device that causes the main shaft 14 to rotate. As the main shaft 14 first starts rotating, the entire marking device 10 rotates. However, at some point the stop bar 50 strikes a portion of the machine tool, causing all but the main shaft 14 and cam 22 to stop rotating. As the cam 22 rotates with respect to the stationary housing 33 and stylus 20, the anvil 44 tracks along the underside 28 of the cam 22. As used herein, the phrase "tracks along" means either (i) that the anvil 44 contacts and slides along the underside of cam, or (ii) that the anvil 44 is positioned close enough to the underside of the cam to hit the cam lobes as they pass, but is not necessarily contacting the cam. Which arrangement actually occurs in practice will depend on the exact dimensions of the various components of the marking device.

As one of the cam lobes 26 comes into contact with the anvil 44, the stylus 20 is forced axially downwards (e.g., away from the cam), compressing the spring 46. As the stylus 20 moves downwards, the point 42 extends past the guide 19 and impacts the part 30 to be marked, as shown in FIG. 1. The impact displaces a small amount of material, creating a small, shallow, conical impression. Once the lobe 26 passes the anvil 44, the spring 46 causes the stylus 20 to return to its normal position tracking along the underside of the cam.

FIGS. 2 and 3 best show the shapes of the lobes 26 and anvil 44 and how they interact. The top surface of the anvil 44 annularly slopes at an angle $\alpha$=15°. More specifically, the bottom portion of the anvil 44 is cylindrical, and its top portion is a conical frustum having a 15° sloping slide 52. The lobes 26 are trapezoidal solids whose side surfaces 54 slope at an angle $\beta$=15°. As best seen in FIG. 3, the lobes 26 are positioned such that their side surfaces 54 are tangentially oriented with respect to the cam 22. In operation, as the cam lobes 26 contact the anvil 44, the lobes' side surfaces 54 slide against the anvil's sloping side 52, forcing the stylus 20 downwards with minimal frictional or mechanical interaction. As should be appreciated, the lobes 26 are each provided with trailing and leading side surfaces 54 so that the marking device 10 will function no matter which direction the main shaft 14 is rotating.

Regarding system level operation, the marking device 10 is typically used in conjunction with a CNC (computer numerically controlled) machine 72 which supplies the movement of the marking device 10 and work piece 30. The CNC machine will be programmed on a path which will produce the desired design or character by reading lines of programming code and moving the machine to the programmed coordinates as the stylus 20 is periodically forced axially downwards. A typical machine program would consist of line numbers, T codes, G codes, M codes, X, Y, Z codes, and S codes, which are all instructions for the machine. When the machine control reads a line of code, it performs the instruction and reads the next line of code.

In this manner, the CNC machine will: (a) read the instruction to select the marker from the available tools (T0 . . . ), via a robotic arm or the like; (b) start the spindle rotation (G0 . . . ); and (c) select a spindle speed (S . . . ). Given the spindle's rate of rotational movement (RPMs) and the number of lobes 26, the machine will know the number of stylus extensions per minute and, consequentially, how much time there is between each downwards extension of the stylus 20. With this information, the machine can appropriately: (d) orient the spindle relative to the workpiece to be marked (X . . . , Y . . . , Z . . . ); and (e) move the machine axis so that the conical impressions created by the marker will be put into the appropriate shape and form to produce the desired identifying mark.

Of course, the marking device 10 does not have to be used with CNC machines. Instead, in can be used with any machine tool having a rotating spindle. For example, the marking device 10 could be attached to a manual drill press, with an operator manually moving the work piece to form a particular shape as the stylus reciprocates.

The cam 22 can be provided with any number of lobes as is desired, depending on the particular application or manufacturer's requirements. Obviously, more cams will produce more stylus extensions per cam revolution. Since the speed of the spindle can be adjusted to control the stylus extension timing, typically only one to four cams are needed.

Although the cam lobes 26 are shown as separate elements located on the underside 28 of the cam 22 near its edge, it should be appreciated that this has been done only for clarity of illustration. In practice, say for a two lobed cam, as shown in FIG. 3, the cam is initially provided as a cylinder, which is then ground down to form a lobe "ridge" extending across the underside of the cam. Drilling the cam's central through-bore divides the ridge in half to effectively form the two lobes. Providing a second lobe ridge perpendicular to the first will provide two additional lobes 26 (not shown).

Additionally, the main shaft 14 has been illustrated as a simple cylinder for clarity of illustration. In practice, the main shaft 14 may need to be tapered to facilitate various friction fits or other connections.

The general idea behind the main shaft/cam/anvil arrangement is to use a machine tool's rotating spindle to power the axially reciprocating stylus. Therefore, it should be appreciated that other energy transferring mechanisms can be used to power the axially reciprocating stylus if the marking device is intended for use with machine tools having other types of output power sources.

For example, the marking device could be electrically powered, with the main shaft being operably connected to a drive motor (or, the main shaft itself could be the motor's drive shaft). Furthermore, for use with an air-powered machine tool, the marking device could be outfitted with a standard air motor contained within the housing, whose drive shaft would rotate the cam, as well as with standard air feed lines and controls and exhaust lines for running the motor. In this case, the main shaft would be fully contained within the housing, and the marking device would be removably attached to the machine tool via extension arms (similar to the stop rod 50), brackets, or the like, through which it would also be possible, if desired, to run the air supply and/or exhaust lines. One air motor-based power design suitable for conversion for use with the marking device is shown in U.S. Pat. No. 5,918,686 to Izumisawa, the entirety of which is hereby incorporated by reference.

Since certain changes may be made in the above described marking device, without departing from the spirit and scope of the invention herein involved, it is intended that all of the subject matter of the above description or shown in the accompanying drawings shall be interpreted merely as examples illustrating the inventive concept herein and shall not be construed as limiting the invention.

For example, although many of the parts of the present invention described herein have been noted as being made of a particular metal, one of ordinary skill in the art will appreciate that the various parts could be made from a number of different metals without departing from the spirit and scope of the invention. Additionally, depending on the particular application and/or the hardness of the part being marked, the parts could be made of other materials such as plastic. Furthermore, rubber or polymer bushings or the like could be used to bias the stylus instead of the spring, and the stop rod could be temporarily affixed to the machine tool, when the marking device is first positioned for use, to prevent the body from rotating with the main shaft. Furthermore, the stylus could be non-slidably connected to the housing via a polymeric membrane stretched across an opening in the bottom plate, or via some other such arrangement.

Having thus described the invention, what is claimed is:

1. A marking device for use with a CNC machine or other machine tool, said marking device comprising:

a. a housing;

b. a reciprocative stylus supported by the housing and extensible beyond the housing to mark a part external to the housing;

c. a stylus driving means supported within the housing for controllably causing the stylus to reciprocate; and d. a machine tool interface means operably connected to the housing and to the stylus driving means for operating the stylus driving means, said machine tool interface means extending beyond the housing and being configured to be engaged and driven by the CNC machine or other machine tool, wherein a rate of stylus reciprocation is a direct function of CNC machine or other machine tool operation.

2. The marking device of claim 1 further comprising a rotation prevention means attached to the housing for preventing the housing from rotating during operation of the marking device at least subsequent an initial period of rotation.

3. The marking device of claim 1 wherein:

a. the stylus driving means comprises a rotatable cam having at least one lobe disposed on an underside thereof; and b. the reciprocative stylus normally tracks along the underside of the cam.

4. The marking device of claim 3 wherein:

a. an anvil end of the stylus normally tracking along the underside of the cam comprises a conical frustum having a sloping side wall; and b. the at least one lobe comprises a generally trapezoidal solid having sloping sides tangentially oriented to the cam.

5. The marking device of claim 4 wherein the sloping side wall of the stylus and the sloping sides of the at least one cam lobe slope at substantially 15°.

6. A marking device for use with a CNC machine or other machine tool, said marking device comprising:

a. a housing;

b. a shaft rotatably supported within the housing, said shaft extending beyond the housing and being configured to be engaged and rotated by the CNC machine or other machine tool;

c. a cam attached to the shaft and positioned within an interior of the housing, said cam having at least one lobe disposed on an underside thereof; and d. a reciprocative stylus supported by the housing, and said stylus normally tracking along the underside of the cam and being moveable to a displaced position, wherein: when the at least one lobe contacts the stylus, a portion of the stylus moves away from the housing; as the shaft and cam rotate with the housing remaining stationary, the at least one lobe periodically contacts the stylus, forcing it to axially reciprocate and mark a workpiece located external the housing; and a rate of stylus reciprocation is a direct function of CNC machine or other machine tool operation, by virtue of the CNC machine or other machine tool rotating the shaft.

7. The marking device of claim 6 wherein the housing has a through-bore, and the stylus extends from the interior of the housing into the through-bore and is slidable therein.

8. The marking device of claim 7 wherein the stylus comprises:

a. a cylindrical stylus shaft having a first end and a second end;

b. an anvil attached to the first end of the stylus shaft for tracking along the underside of the cam; and c. a marking tip attached to the second end of the stylus shaft.

9. The marking device of claim 8 wherein the stylus is biased via a spring concentrically disposed about the stylus shaft and positioned between the anvil and the housing.

10. The marking device of claim 8 wherein the anvil comprises a conical frustum having a sloping side wall.

11. The marking device of claim 10 wherein the sloping side wall slopes at substantially 15°.

12. The marking device of claim 6 wherein the at least one lobe is a generally trapezoidal solid having sloping sides that are tangentially oriented to the cam.

13. The marking device of claim 12 wherein the lobe sides slope at substantially 15°.

14. The marking device of claim 6 further comprising a stop rod attached to the outside of the housing and extending away therefrom; whereby when the shaft is rotated by the CNC machine or other machine tool and the housing initially rotates along with it, the stop rod eventually contacts the CNC machine or other machine tool and prevents the housing from further rotating.

15. The marking device of claim 6 wherein the housing is generally cylindrical and comprises: a tubular body; a top plate attached to a first end of the body; and a bottom plate attached to a second end of the body.

16. The marking device of claim 15 wherein:

a. the shaft extends through the top plate, into the housing interior, through the cam, and terminates at the bottom plate, and is rotatably connected to the housing via bearings attached to the top and bottom plates; and b. the stylus is supported by the bottom plate.

17. The marking device of claim 6 wherein:

a. an anvil end of the stylus comprises a conical frustum having a sloping side wall; and b. the at least one lobe is a generally trapezoidal solid having sloping sides that are tangentially oriented to the cam.

18. The marking device of claim 17 wherein the sloping side wall slopes at substantially 15°, and the sides of the at least one lobe slope at substantially 15°.

19. A marking device for use with a CNC machine or other machine tool, said marking device comprising:

a. a housing having an interior and a through-bore;

b. a rotatable shaft having one end supported within the housing and another end extending through and beyond an opening in the housing, said shaft being configured to be engaged and rotated by the CNC machine or other machine tool;

c. a cam attached to the shaft and positioned within the interior of the housing, said cam having at least one lobe disposed on an underside thereof; and d. a stylus, slidably supported within the through-bore, said stylus having a first, anvil end extending into the housing and a second, marking end, wherein the stylus is biased so that the first end normally tracks along the underside of the cam, wherein the second end partially extends past the housing when the at least one lobe strikes the first end of the stylus; and wherein a rate of stylus reciprocation is a direct function of CNC machine or other machine tool operation, by virtue of the CNC machine or other machine tool rotating the shaft.

20. The marking device of claim 19 wherein the through-bore is provided in a guide attached to the housing and extending from the interior of the housing to outside the housing.

21. The marking device of claim 19 wherein the anvil end of the stylus and the marking end of the stylus are connected via a cylindrical stylus shaft.

22. The marking device of claim 21 wherein the stylus is biased via a spring concentrically disposed about the stylus shaft and positioned between the anvil and the housing.

23. The marking device of claim 21 wherein the stylus is biased via a polymeric bushing concentrically disposed about the stylus shaft and positioned between the anvil and the housing.

24. The marking device of claim 21 wherein the marking end is conical.

25. The marking device of claim 21 wherein the anvil end of the stylus comprises a conical frustum having a sloping side wall.

26. The marking device of claim 25 wherein the sloping side wall slopes at substantially 15°.

27. The marking device of claim 19 wherein the at least one lobe is a generally trapezoidal solid having sloping sides that are tangentially oriented to the cam.

28. The marking device of claim 27 wherein there are two lobes spaced equidistantly around the underside of the cam.

29. The marking device of claim 27 wherein there are four lobes spaced equidistantly around the underside of the cam.

30. The marking device of claim 27 wherein the lobe sides slope at substantially 15°.

31. The marking device of claim 19 further comprising a stop rod attached to the outside of the housing and extending away therefrom; whereby when the shaft is rotated by the CNC machine or other machine tool and the housing initially rotates along with it, the stop rod eventually contacts the CNC machine or other machine tool and prevents the housing from further rotating.

32. The marking device of claim 19 wherein the housing is generally cylindrical and comprises: a tubular body; a top plate attached to and covering a first end of the body; and a bottom plate attached to and covering a second end of the body.

33. The marking device of claim 32 wherein:

a. the shaft extends through the top plate, into the housing interior, through the cam, and terminates at the bottom plate, and is rotatably connected to the housing via bearings attached to the top and bottom plates; and b. the through-bore is provided in the bottom plate.

34. The marking device of claim 19 wherein:

a. an anvil end of the stylus normally tracks along the underside of the cam and comprises a conical frustum having a sloping side wall; and b. the at least one lobe is a generally trapezoidal solid having sloping sides that are tangentially oriented to the cam.

35. The marking device of claim 34 wherein the sloping side wall slopes at substantially 15°, and the sides of the at least one lobe slope at substantially 15°.

36. A marking device for use with a CNC machine or other machine tool, said marking device comprising:

a. a housing;

b. a shaft rotatably connected to the housing and extending beyond the housing and being configured to be engaged and rotated by the CNC machine or other machine tool;

c. a cam attached to the shaft and positioned within an interior of the housing, said cam having at least one lobe disposed on an underside thereof; and d. a reciprocative stylus supported by the housing and normally tracking along the underside of the cam, wherein a portion of said stylus is extensible beyond the housing to mark a part external to the housing when the stylus is struck by the at least one lobe, and wherein a rate of stylus reciprocation is a direct function of CNC machine or other machine tool operation, by virtue of the CNC machine or other machine tool rotating the shaft.

37. A marking device for use with a CNC machine or other machine tool, said marking device comprising:

a. a housing having an interior and a through-bore;

b. a shaft rotatably connected to the housing and extending beyond the housing and being configured to be engaged and rotated by the CNC machine or other machine tool;

c. a cam attached to the shaft and positioned within an interior of the housing, said cam having at least one lobe disposed on an underside thereof; and d. a stylus biased to normally track along the underside of the cam and extending from the housing interior into the through-bore and slidable therein, wherein the stylus is dimensioned to partially extend past the housing when the at least one lobe strikes the stylus, and wherein a rate of stylus reciprocation is a direct function of CNC machine or other machine tool operation, by virtue of the CNC machine or other machine tool rotating the shaft.

38. A marking device for use with a CNC machine or other machine tool, said marking device comprising:

a. a housing having: a top; and a bottom opposite the top;

b. a shaft rotatably connected to the housing and configured to be rotated by a spindle portion of the CNC machine or other machine tool, wherein shaft rotation is a direct function of CNC machine or other machine tool operation;

c. a cam attached to the shaft and positioned within an interior of the housing, said cam having at least one lobe disposed on an underside thereof; and d. a reciprocative stylus supported by the housing and normally tracking along the underside of the cam, wherein:

i. the stylus is extensible beyond the housing bottom to mark a part beneath the housing bottom when the stylus is struck by the at least one lobe; and ii. the stylus is parallel to the shaft, such that the marking device is suitable for marking items generally longitudinally aligned with the shaft.

* * * * *